United States Patent [19]

Walter

[11] Patent Number: 4,519,345

[45] Date of Patent: May 28, 1985

[54] ADJUSTABLE RATIO ROCKER ARM

[76] Inventor: Bob Walter, 19361 Lake Chabot Rd., Castro Valley, Calif. 94546

[21] Appl. No.: 586,231

[22] Filed: Mar. 5, 1984

[51] Int. Cl.[3] ..... F01L 1/18

[52] U.S. Cl. ..... 123/90.16; 123/90.39

[58] Field of Search ..... 123/90.15, 90.16, 90.39, 123/90.41, 90.44, 90.43, 90.61

[56] References Cited

U.S. PATENT DOCUMENTS

| | | | |
|---|---|---|---|
| 1,481,951 | 1/1924 | Asbury | 123/90.41 |
| 1,515,201 | 11/1924 | Hewitt | 123/90.39 |
| 1,654,020 | 12/1927 | Schmidt | 123/90.16 |
| 3,791,355 | 2/1974 | Bergmann et al. | 123/90.43 |
| 4,077,369 | 3/1978 | Buehner | 123/90.16 |
| 4,187,810 | 2/1980 | Buehner | 123/90.16 |

FOREIGN PATENT DOCUMENTS

| | | | |
|---|---|---|---|
| 2853688 | 6/1980 | Fed. Rep. of Germany | 123/90.44 |
| 148913 | 11/1980 | Japan | 123/90.16 |
| 467242 | 6/1937 | United Kingdom | 123/90.44 |

*Primary Examiner*—Ira S. Lazarus
*Assistant Examiner*—R. S. Bailey
*Attorney, Agent, or Firm*—Linval B. Castle

[57] ABSTRACT

Adjustments to the amount of valve lift in an engine are readily made by corresponding adjustments to the location at which a cam actuated push rod contacts the push rod side of the valve actuating rocker arm. The invention provides an accurate and rapid means for adjusting the push rod contact position by slotting the push rod side of the rocker arm and fitting a square adjustment plate against a fixed index on top and bottom surfaces of the push rod side. Each adjustment plate has a hole for accommodating a tappet bolt and the holes are off-center located so that there is a different space between the hole and each of the square plates' four edges that may be rotated to a position against the fixed index to provide any one of four separate rocker arm ratios and therefore amounts of valve lift.

2 Claims, 11 Drawing Figures

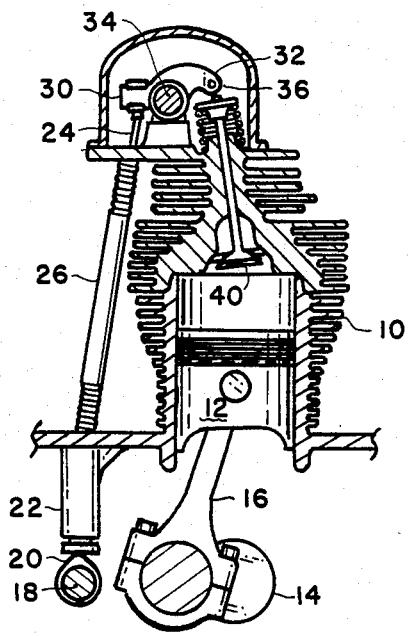
FIG. 1
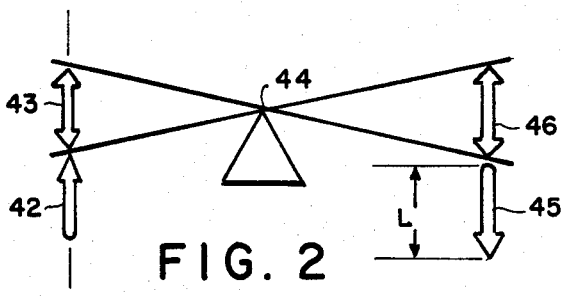
FIG. 2
FIG. 3
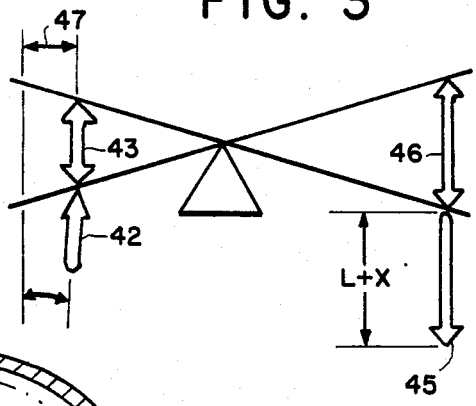
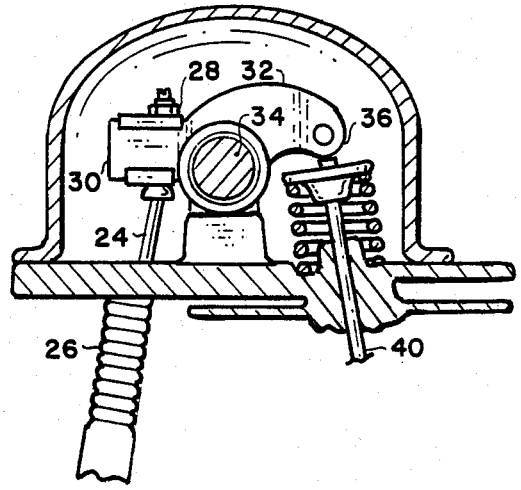
FIG. 4

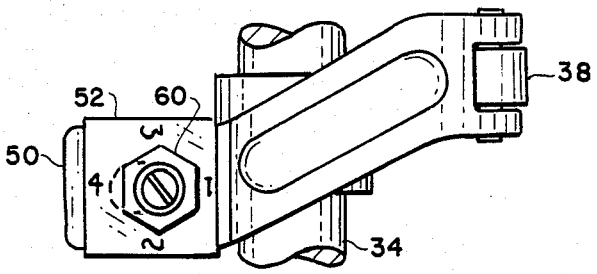
FIG. 5
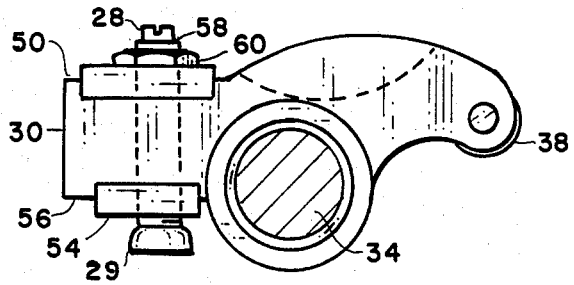
FIG. 6
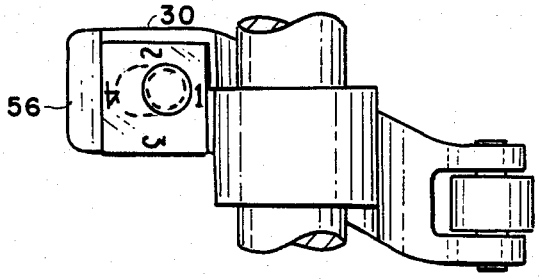
FIG. 7
FIG. 8
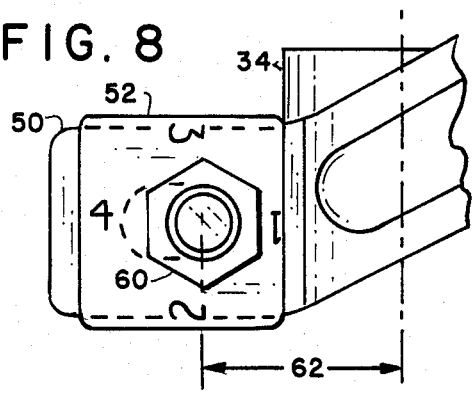
FIG. 9
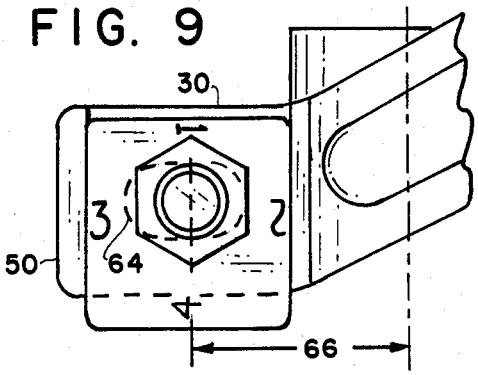
FIG. 10
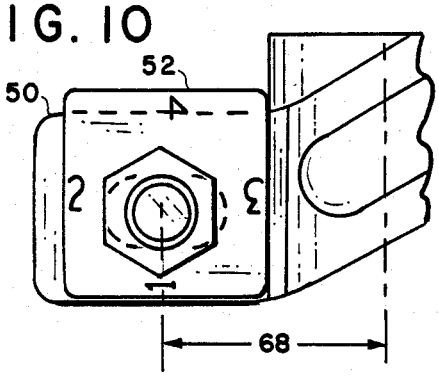
FIG. 11
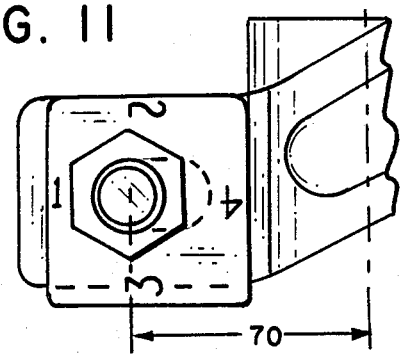

ADJUSTABLE RATIO ROCKER ARM

BRIEF SUMMARY OF THE INVENTION

This invention relates generally to rocker arms such as used for valve actuation in internal combustion engines, and in particular to a novel means for varying the rocker arm stroke and hence the valve lift by adjusting the point at which a push rod contacts the rocker arm.

In internal combustion engines, the valve lift is determined by the shape and dimensions of the engine cams rotating on a camshaft which is rotated by gearing attached to the engine crankshaft. In conventional engines the amount of valve lift, and hence the speed at which it opens and closes, are fixed values determined by the manufacturer for optimum engine power, acceleration, and exhaust requirements.

It is often desired to modify an engine to increase power and speed performances by, for example, increasing the opening and speed of operation of intake valves to more rapidly introduce the fuel/air mixture into the cylinders. Such alterations have generally been made to engines rebuilt for competition use and have heretofore required the engine rebuilder to install especially designed high lift cams. An engine thus equipped has increased power and improved acceleration characteristics but usually performs poorly at low speeds and is not ideal for general street use unless the conventional, manufacturer's recommended cams are reinstalled. In most engines, this is very difficult and costly task requiring the removal and reinstallation of radiator, timing gear cover, gear chain and other major items.

The present invention is for an adjustable ratio rocker arm which permits a simple and rapid means for adjusting the opening of exhaust and/or intake valves at various points between manufacturer's predetermined settings and a high valve lift position without removal of any part of the engine except the rocker arm cover.

Briefly described, the adjustable ratio rocker arm of the invention includes rocker arms having the usual valve arm at one side of the rocker shaft and, on the opposite side thereof, a push rod arm having an elongated vertical adjustment slot down through the arm and out along an axis at right angles to the axis of the rocker arm shaft. Locked in position on the top and bottom surfaces of the push rod arm are square adjustment members each having an off-center hole therethrough for receiving an adjustable tappet bolt with concave lower bell end for receiving the spherical top end of an associated push rod. Upon the loosening of the tappet bolt, the square adjustment members may be rotates to any one of four positions so that the tappet bolt in the off-centered holes may be positioned at a corresponding one of four distances from the pivot point of the rocker arm shaft to thereby vary the length of the swing of the valve arm of the rocker and hence the opening of the associated valve.

DESCRIPTION OF THE DRAWINGS

In the drawings which illustrate the preferred embodiment of the invention:

FIG. 1 is a sectional view of the adjustable ratio rocker arm in a typical internal combustion engine;

FIGS. 2 and 3 are schematic drawings illustrating the theory of operation of the adjustable ratio rocker arm;

FIG. 4 is an enlarged drawing illustrating in detail the rocker arm of the invention;

FIG. 5 is a plan view of the rocker arm and illustrates the ratio adjustment plate on the push rod arm;

FIG. 6 is a side elevational view of the rocker arm of FIG. 5;

FIG 7 is a bottom view of the rocker arm of FIGS. 5 and 6; and

FIGS. 8 through 11 are enlarged plan views of the push rod arm and illustrate in detail the various ratio adjustments of the rocker arm.

DETAILED DESCRIPTION OF THE INVENTION

FIG. 1 is a sectional view of a typical "suitcase" engine cylinder assembly such as that used in Volkswagon engines and illustrates one cylinder head 10 having therein a piston 12 that is connected to the engine crankshaft 14 by a connecting rod 16. Geared to rotate a half rotation for each full rotation of the crankshaft 14 is a camshaft 18 to which is connected a plurality of cams such as the cam 20. A high point on the cam 20 causes a lifter 22 to push upward a push rod 24 slideably housed in a suitable push rod guide tube 26. As best illustrated in the enlarged view of FIG. 4, the top end of the push rod 24 has a spherical end which engages a concave bell shaped lower end of an adjustable tappet bolt 28 that extends vertically through the push rod arm 30 of a rocker 32 mounted for rotational movement upon a rocker arm shaft 34. The valve arm 36 on the opposite side of the shaft 34 from the push rod arm preferably has an end roller 38, as shown in FIGS. 5–7, which contacts the stem end of a spring biased intake or exhaust valve 40 to respectively admit a fuel/air mixture or vent burnt gasses from the engine cylinder in proper synchronization with the stroke of the piston 12.

FIGS. 2 and 3 illustrate the principle of operation of the adjustable ratio rocker arm. FIG. 2 schematically illustrates the operation of a typical manufacturer specified rocker arm system for general street operation of a vehicle. The arrow 42 represents the movement of a cam actuated push rod, and the arrow 43 represents the length of vertical movement of the push rod arm of a rocker pivoted and a fulcrum point 44 which represents the point of rotation about the rocker arm shaft 34. If the lever arm between the fulcrum 44 and the position of the push rod represented by the arrow 42 is precisely equal to that between fulcrum 44 and the arrow 45, representing the movement of the valve arm 36 caused by corresponding movement 46 of the roller end of the valve arm of the rocker, then the valve movement 45 will precisely correspond to the push rod movement 42 as indicated in FIG. 2 by the length L.

As illustrated in FIG. 3, the position of the push rod has been moved toward the fulcrum 44 by an amount 47. Because the engine cam remains unchanged, the push rod movement 42 and push rod arm movement 43 also remain unchanged from that of FIG. 2. But because the lever arm between push rod and fulcrum has been reduced by the amount 47, the valve arm movement 46 and corresponding valve movement 45 will be increased to a length, L+X, wherein X is proportional to the amount of reduction in length the lever arm 48. Therefore, any reduction in the length between the rocker arm shaft 34 and the point at which the push rod 24 contacts the push rod arm 30 will product a corresponding increase in the opening of the valve 40. The lengthened valve movement in FIG. 3 may produce a valve lift corresponding to that obtained by special high lift cams previously discussed.

FIGS. 5–7 illustrate the means by which the ratio of valve arm to push rod arm length may be varied. The push rod arm 30 on the rocker arm is formed with substantially parallel planar top and bottom surfaces each with an outboard lip for confining a square adjustment plate. Thus, the top surface of the arm has a lip 50 with a straight lateral edge. The square adjustment plate 52 is clamped upon the top planar surface of the arm with one edge of the plate against the lateral inboard edge of the lip 50. Similarly, a second smaller adjustment plate 54 is located on the lower planar surface of the arm and against the lateral inboard edge of the lip 56. A bolt 58 is threaded through an off-centered hole through the lower plate 54 and extends through the elongated slot through the arm 30 and a similarly off-centered hole in the upper adjustment plate 52. A bell is formed at the lower end of the bolt 58 for receiving the spherical upper end of a push rod, and a screwdriver slot cut in the upper end provides for vertical adjustment of the tappet bolt 58. A threaded locking nut 60 on the upper end of the bolt 58 secures both adjustment plates to the push rod arm 30.

FIGS. 8 through 11 illustrate the upper adjustment plate in detail and the means for varying the rocker arm ratios. The hole through both the lower plate 54 and the upper adjustment plate 52 is off-centered from both the central X and Y axes of the plates by differing distances so that there are different spacings between the hole center and each of the four sides of the square plates. To vary the length ratios between valve arm and push rod arm, and thus vary the valve lift as discussed in connection with FIGS. 2 and 3, it is only necessary to loosen the nut 80 and rotate both lower and upper adjustment plates to place the tappet bolt in the off-centered holes at a desired arm length 62 from the fulcrum, or rotational center of the rocker arm shaft 34.

In the preferred embodiment the four edges of each of the adjustment plates are numbered to identify each of the four different arm lengths. Thus, in FIG. 8 the numeral "4" on the upper adjustment plate 52 near the edge adjacent the lip 50 identifies a relatively short arm length 62 and a rocker arm ratio of perhaps 1:25:1, corresponding to a valve opening that may be obtained by a high lift cam.

In FIG. 9, the adjustment plates have been rotated a quarter turn to a position "3" to place the contact point of the push rod about a third through the lenght of the elongated slot 64, shown by the dashed lines. This increases the lever arm of the push rod arm 30 to an arm length 66 and may provide a rocker arm ratio of perhaps 1.33:1. In FIG. 10, the lower and upper adjustment plates have again been rotated to a position "2" to further increase the lever arm length 68 and provide a rocker arm ratio of perhaps 1.4:1. The rotation of the plates to position "1" extends the push rod arm length 70 to its extreme position in the slot 64 and may provide the rocker arm ratio of 1.25:1, corresponding to a valve opening that may be obtained by a standard "street" or manufacturer's cam.

Therefore, by merely loosening the tappet bolt nut 60, the adjustment plates may be rotated to any one of four positions to obtain the results obtained by virtually any desired engine cam between that prescribed for general use to special high lift cams often used competition engines.

I claim:

1. A method for altering the amount of valve lift in apparatus employing a cam actuated push rod, a rocker arm rotational about an axis and having a first leg displaced on one side of said axis and contacting one end of said push rod and a second leg displaced from said axis and contacting the stem end of a spring biased valve, said method comprising the steps of:

providing said first rocker arm leg with substantially flat, parallel first and second surfaces with an elongated slot intersecting said surfaces and through said first leg, each of said first and second surfaces having a projecting lip extending across the exterior end, said slot being aligned on an axis substantially perpendicular to the rotational axis of said rocker arm;

positioning first and second substantially square adjustment plates respectively on said first and second parallel surfaces, said adjustment plates having corresponding holes therethrough with the hole through said first plate being threaded, the position of said holes being offcenter and at differing distances from each edge of the substantially square plates, one edge of each of said plates being secured against the projecting lip across the exterior end of its respective flat parallel surface;

inserting a threaded tappet bolt through said first arm slot, and said first and second adjustment plates, said threaded bolt engaging the threaded hole in said first plate, the first end of said bolt having socket means for engaging the end of the cam actuated push rod;

securing said tappet bolt at a desired position in said first arm slot by applying and tightening a threaded nut to the end of said bolt extending from said second adjustment plate; and adjusting the position of said tappet bolt along the length of said slot by loosening said threaded nut and rotating said first and second adjustment plates on said parallel surfaces as desired to thereby vary the effective push rod arm length and the stroke of the valve.

2. A variable ratio rocker arm for readily altering the amount of valve lift in an engine having a cam actuated push rod contacting the bell end of a tappet bolt in the push rod arm of a rocker arm, the opposite valve arm of which contacts the end of a stem of a spring biased valve, said variable ratio rocker arm comprising:

a central portion having a lateral aperture for rotationally mounting said rocker arm to a rocker arm shaft;

a valve arm on one side of said central portion and displaced from said rocker arm shaft by a fixed predetermined spacing, said valve arm having means adjacent its outer end for contacting the end of a valve stem;

a push rod arm on the opposite side of said central portion, said push rod arm having an elongated slot extending therethrough and along a lateral axis substantially perpendicular to the axis of said rocker arm shaft, said arm having substantially flat, parallel first and second surfaces intersecting said slot, the exterior edge of each of said surfaces having substantially straight lips extending above said surfaces;

first and second substantially square adjustment plates respectively positioned on said first and second surfaces and against the lips across the edges thereof, said plates having coaxial holes therethrough and aligned with said slot through said arm, said holes being offcenter and spaced from each edge of said plates by differing distances, the hole through said first plate being threaded;

a threaded tappet bolt threaded through the hole through said first adjustment plate and extending through said slot and said second adjustment plate, the bell end of said bolt located adjacent said first adjustment plate and the opposite end of said bolt extending from said second adjustment plate; and a nut threaded on said tappet bolt adjacent said second adjustment plate for securing said tappet bolt to said push rod arm, for adjusting the effective length of said tappet bolt and for loosening said adjustment plates for rotation on their respective surfaces and the resulting positioning adjustment of the push rod.

* * * * *